US005403373A

United States Patent [19]

Kitagawa et al.

[11] Patent Number: 5,403,373

[45] Date of Patent: Apr. 4, 1995

[54] HARD SINTERED COMPONENT AND METHOD OF MANUFACTURING SUCH A COMPONENT

[75] Inventors: Nobuyuki Kitagawa; Toshio Nomura, both of Hyogo, Japan

[73] Assignee: Sumitomo Electric Industries, Ltd., Osaka, Japan

[21] Appl. No.: 889,854

[22] Filed: May 28, 1992

[30] Foreign Application Priority Data

May 31, 1991 [JP] Japan ..... 3-155489

[51] Int. Cl.[6] ..... C22C 29/04; B22F 1/00

[52] U.S. Cl. ..... 75/238; 75/239; 75/240; 75/242; 75/246; 419/13; 419/14; 419/15; 419/16; 419/36; 419/38

[58] Field of Search ..... 75/238–240, 75/242, 246; 419/13, 14, 15, 16, 36, 38, 44

[56] References Cited

U.S. PATENT DOCUMENTS

| | | | |
|---|---|---|---|
| 4,113,480 | 9/1978 | Rivers | 419/2 |
| 4,721,599 | 1/1988 | Nakamura | 419/23 |
| 4,867,943 | 9/1989 | Kiyota | 419/23 |
| 5,015,294 | 5/1991 | Ludwig | 106/268 |
| 5,045,276 | 9/1991 | Kijima | 419/9 |
| 5,108,492 | 4/1992 | Kiyoto et al. | 75/246 |
| 5,141,554 | 8/1992 | Kijima | 75/246 |

FOREIGN PATENT DOCUMENTS

| | | |
|---|---|---|
| 0412743 | 2/1991 | European Pat. Off. . |
| 0443048 | 8/1991 | European Pat. Off. . |
| 1-129907 | 5/1989 | Japan . |
| 2-015139 | 1/1990 | Japan . |

*Primary Examiner*—Ngoclan T. Mai

*Attorney, Agent, or Firm*—W. G. Fasse; W. F. Fasse

[57] ABSTRACT

A hard sintered component of a cemented carbide or a stellite alloy having a complex three-dimensional shape and a small hole or the like and the high strength originally provided by the used material for making the component without any secondary working, is formed by injection molding a compact molding die having an inner mold surface roughness $R_{max}$ of not more than 3 μm. Where a core pin is used the outer surface of the pin has a surface roughness $R_{max}$ of not more than 3 μm. The compact is then sintered. The hard sintered component is composed of a cemented carbide or a stellite alloy. In such a hard sintered component, the surface of a complex three-dimensional shape such as a disc portion or a thin portion, or the inner surface of a small hole, is defined by a sintered surface which has a surface roughness $R_{max}$ of not more than 4 μm.

15 Claims, 3 Drawing Sheets

HARD SINTERED COMPONENT AND METHOD OF MANUFACTURING SUCH A COMPONENT

FIELD OF THE INVENTION

The present invention relates to a hard sintered component, such as a wear resistant component or a sliding component, of a cemented carbide or an alloy corresponding to stellite having a complex shape, and a method of manufacturing such a component.

BACKGROUND INFORMATION

In general, a wear resistant component or a sliding component is made of a cemented carbide which is based on WC, TaC or TiC, or an alloy corresponding to stellite which is based on Co-Cr-W. Such an alloy is prepared by binding hard particles of a carbide, a nitride and/or a carbonitride of W, Ta, Ti and/or Cr with an iron family metal such as Co, Fe or Ni through a well-known powder metallurgical method. More specifically, WC powder, TaC powder, Co powder and/or Ni powder are mixed with each other in accordance with a prescribed alloy composition and the mixed raw material powder is then die compacted or CIP-formed and the resulting compact is sintered.

In such a conventional method, however, the resulting product has its limitations regarding its shape in its dimensional accuracy since the compact is obtained by die compaction. Due to a uniaxial compacting pressure applied in the die compaction process, it is difficult to mold a material into a compact which is provided with holes or which has a plurality of surfaces along directions inclined against the pressing direction. Further, it is impossible to mold a material into a compact which is provided with grooves, thread grooves, knurls and the like in different directions with respect to a hole. If the compact has portions which are different in thickness from each other in excess of about 1.5 times, on the other hand, it is impossible to attain a homogeneous powder density and hence a difference is caused in the contraction during the sintering process, leading to a distortion of the component.

Although it is possible to mold a material into a compact having such a three-dimensional shape by CIP-forming, a sufficient accuracy cannot be attained by CIP-forming since the material is molded in a die of rubber. In order to obtain a component having a complex three-dimensional shape, a small hole or the like, therefore, it is necessary to secondarily work a sintered body which is first prepared in a simple shape.

In order to work a cemented carbide or an alloy of stellite which is extremely hard to work, however, it is necessary to grind the material with a diamond grindstone or apply an electric discharge machining. In particular, electric discharge machining is required for forming a small hole or the like. When a sintered body of a cemented carbide or a stellite alloy is subjected to electric discharge machining, however, small cracks or even breakage may be caused in or of the working surface by an external shock, whereby the entire component can break.

Although there is a well-known method of machine-working a compact which is obtained by die compaction or CIP forming into a complex shape and thereafter sintering the same, such a compact cannot attain a sufficient strength after the machine working. Thus, it is impossible to reduce the compact in thickness and work the same into a complex shape having a high dimensional accuracy, while breakage is easily caused by the machine work which reduces the strength of the sintered body.

Thus, it has been difficult to obtain a wear resistant component or a sliding component of a cemented carbide or a stellite alloy in a complex shape. As to a component which is machine-worked into a complex shape, on the other hand, it has been impossible to obtain the original strength that could be provided by starting material.

SUMMARY OF THE INVENTION

In consideration of the aforementioned circumstances of the prior art, it is an object of the present invention to provide a hard sintered component of a cemented carbide or a stellite alloy having a complex shape specifically a complex three-dimensional shape or configuration, a small hole, or the like while avoiding secondary working such as electric discharge machining nor other machining, and a method of manufacturing such a hard sintered component.

In order to attain the aforementioned object, the hard sintered component according to the present invention is made of a cemented carbide or a stellite alloy, with a complex three-dimensional curved surface or which has a thin portion which component is formed by a sintered surface having a surface roughness $R_{max}$ of not more than 4 $\mu$m, or a small hole whose inner peripheral surface is formed by a sintered surface having surface roughness $R_{max}$ of not more than 4 $\mu$m.

The method according to the invention for manufacturing such a hard sintered component, comprises preparing a molding die provided with an inner peripheral surface having surface roughness $R_{max}$ of not more than 3 $\mu$m in a portion corresponding to the complex three-dimensional configuration or a thin portion of the compact, or to comprise a core pin provided with an outer peripheral surface having a surface roughness $R_{max}$ of not more than 3 $\mu$m in a portion corresponding to the inner peripheral surface of a small hole of a compact, preparing a raw material powder of a cemented carbide or a stellite alloy by kneading with an organic binder to form an injection moldable material injection-molding said material into a molding die to form a compact having a three-dimensional curved surface, or a thin portion, or a small hole corresponding to a core pin, and debindering and sintering the compact.

The cemented carbide is obtained by mixing a powder of a carbide, a carbonitride and/or a nitride of an element belonging to the group IVa, Va or VIa of the periodic table with powder of an iron family metal selected from Fe, Co and Ni, and sintering the mixture. The elements belonging to the groups IVa, Va and VIa of the periodic table are Ti, Zr, Hf, V, Nb, Ta, Cr, Mo and W. The stellite alloy is a Co based alloy which is based on Co-Cr-W-C.

In order to avoid the cause of reduction in strength resulting from electric discharge machining in a hard sintered component of a cemented carbide or a stellite alloy portions thereof that were subjected to electric discharge machining, were thoroughly examined. It was found that these portions were affected by embrittling to a depth of about 5 to 10 $\mu$m from the surfaces thereof. Thus, it has been proven that such worked portions affected by embrittling were reduced in their material strength, due to starting points for breakage in response to external shocks. Portions with reduced material strength are inherently damage prone.

It has also been recognized that a continuous scratch line such as a scratch line caused by working easily forms a starting line for breakage even if the compact is worked by machining other than electric spark discharge. Particularly a compact having a surface with a scratch line causing a surface roughness of $R_{max}$ exceeding 4 μm, is very much reduced in strength. A surface portion of a compact also easily forms a starting area for breakage if the area defines a small hole, a complex three-dimensional configuration or a thin portion.

The present invention is based on the foregoing findings. According to the present invention, it is possible to obtain a hard sintered component of a cemented carbide or a stellite alloy having a complex shape, by injection molding, with no secondary working such as electric discharge machining. Further, compacts with a small hole, a complex three-dimensional curved configuration or a thin portion, which otherwise would easily form a starting point for breakage, are provided with a surface roughness $R_{max}$ of not more than 4 μm, whereby it is possible to obtain a hard sintered component having a strength which is originally provided by the cemented carbide or the stellite alloy.

As to portions, particularly thick and simple-shape portions other than the small hole, the complex three-dimensional configuration, or the thin portion, the sintered surfaces may not necessarily have a surface roughness $R_{max}$ of not more than 4 μm since external shocks are hardly concentrated in such portions to disadvantageously reduce the strength. However, it is preferable to provide the overall sintered surfaces with a surface roughness $R_{max}$ of not more than 4 μm.

The hard sintered component of the invention has a complex shape and is manufactured by an injection molding, which has generally been employed for manufacturing plastic products and has recently been used to manufacture ceramic products, to perform a powder metallurgical method for a cemented carbide or a stellite alloy. More specifically according to the invention, raw material powder is kneaded with an organic binder and injected into a molding die for forming a compact which is similar in shape to a hard sintered compact such as a wear resistant component or a sliding component having a complex shape, and the resulting compact is debindered and thereafter sintered to obtain a hard sintered component.

The raw material powder is prepared by appropriately mixing hard particles of WC powder, TaC powder or TiC powder with binder metal powder such as Co powder, Ni powder or Fe powder, in accordance with the composition of a cemented carbide based on W, TaC or TiC, or a stellite alloy based on Co-Cr-W-C. The raw material powder components are simultaneously mixed and pulverized in a ball mill, an attriter or the like in a dry or wet system. The mixed and pulverized raw material powder preferably contains at least 20% of particles of not more than 2 μm in particle diameter, since it is impossible to obtain a sintered body which is close to theoretical density if the material is insufficiently mixed and pulverized.

The organic binder to be kneaded with the raw material powder for injection molding may be prepared from a binder such as polyethylene, polypropylene, polystyrene, acryl, ethylene-vinyl acetate, wax, paraffin or the like, which has generally been employed for injection molding of ceramic products or the like. These binder components may be used singly or in combination.

The molding die which is employed for the injection molding of the present method, the surface state of its inwardly facing surface is particularly important. An ordinary molding die as used heretofore is in such a state that a working scratch line or an electric discharge machining surface resulting from working has not been removed from the inner peripheral surface, or the inner peripheral surface was merely slightly polished. For practicing the method of the invention, however, it is necessary to more smoothly finish the inwardly facing surface of the molding die as compared with a respective die used conventionally in order to obtain a smooth sintered surface of the product.

The overall inwardly facing die or mold surface of the molding die or at least a die surface portion corresponding to a complex three-dimensional configuration curved surface or a thin portion of the compact to be molded, must have a roughness $R_{max}$ of not more than 3 μm. Further, a movable core pin which is inserted in the molding die for forming a small hole in the sintered body, must also have an outer pin surface roughness $R_{max}$ of not more than 3 μm. Such molding die and core pin are so employed that the surface of at least the complex three-dimensional curved surface or the thin portion, or the inner peripheral surface of the small hole molded in the die has a surface roughness $R_{max}$ of not more than 4 μm in the sintered state of the compact.

In a debindering process, the compact is heated depending on the type of the organic binder kneaded therewith, so that the organic binder is melted to flow out of the compact, decomposed, or sublimated. However, since the compact of a cemented carbide or a stellite alloy has a specific gravity which is larger than that of ordinary ceramics or the like, it is necessary to prevent the compact from deforming due to its own weight during the debindering process. The atmosphere for the debindering process is preferably a vacuum or a non-oxidizing gas such as hydrogen gas, nitrogen gas or an inert gas, in order to suppress the oxidation of the raw material powder.

The debindered compact is sintered in a vacuum or hydrogen gas, to convert the compact into a sintered body having a prescribed complex shape. The sintering temperature may be similar to that for sintering a conventional compact obtained by die compaction or CIP forming. However, since the compact may be easily deformed by its own weight, care must be taken that the sintering temperature is too high. The so produced sintered body of a cemented carbide or a stellite alloy is directly formed into a hard sintered component having a complex three-dimensional configuration, a small hole or the like, without any secondary working such as cutting or electric discharge machining. However, a part of its surface may be finished by grinding or the like, depending on its use. Neither the compact nor the sintered body requires any machining operation, dissimilarly to the results of a conventional die compaction by molding under a unidirectional compacting pressure. For example, it is possible to obtain hard sintered compacts having small holes 3 and 6 and complex three-dimensional configurations as shown in FIGS. 1 and 2 in states of sintered surfaces with no secondary working, contrary to a conventional sintered compact which has inevitably required secondary working.

Further, it is also possible to obtain components provided with holes 7 and plural surfaces along directions inclined toward a pressing direction as shown in FIGS. 3 to 5, a component having a funnel hole 8 as shown in FIG. 6, and a component provided with grooves 9, thread grooves or knurls with respect to a hole 7 in directions different from each other as shown in FIG. 7 in sintered surfaces without any secondary working. Even if portions of the components are different in thickness from each other in excess of about 1.5 times as shown in FIGS. 1, 2 and 4, no distortion is caused by difference in a contraction during sintering, and the components can attain high strength also in this respect.

According to the present invention, it is possible to manufacture a hard sintered component of a cemented carbide based on WC or the like or a stellite alloy having a complex three-dimensional curved surface, a thin portion or a small hole with a high dimensional accuracy, with excellent strength which is originally provided by the material used herein, without any requirement for secondary working such as electric discharge machining.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Example 1

Figure 1:
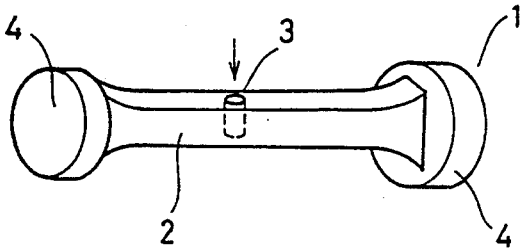
FIG. 1 is a perspective view showing a first example of a hard sintered component having a complex shape according to the present invention.

88 percent by weight of WC powder having a mean particle diameter of 1 μm was mixed with 12 percent by weight of Ni powder having a mean-particle diameter of 2 μm and pulverized in a ball mill containing ethyl alcohol for 30 hours. The so produced mixed powder was dried and then kneaded with 5 percent by weight of paraffin and 2 percent by weight of polyethylene, serving as organic binders, in a kneader for 2 hours. The kneaded substance was injection-molded in a die having a core pin in an injection molding machine, to obtain a compact which was similar in shape to the component shown in FIG. 1. The inner peripheral surface of the die and the outer peripheral surface of the core pin had a surface-finish with a surface roughness $R_{max}$ of not more than 3 μm.

The resulting compact was heated in $N_2$ gas up to 450° C. at a rising temperature rate of 20° C./h and held for 1 hour, so that the organic binders were removed. Then the debindered compact was sintered in a vacuum at 1400° C. for 30 minutes, to prepare a component 1 of a cemented carbide having a composition of 88 wt. % WC–12 wt. % Ni, comprising a prismatic portion 2 provided with a small hole 3 of 1.5 mm having an inner diameter in the component center and a disc portions 4 on each end, as shown in FIG. 1.

A sample 1*a* of the invention was prepared from the so produced component 1, while another sample 1*b* of the invention was prepared in the shape shown in FIG. 1 with an alloy composition which was different from that of the present sample 1*a*. This sample 1*b* was prepared in a manner similar to the above, except that TaC powder of 3 μm in mean particle diameter and Ni powder of 2 μm in mean particle diameter were so employed that the component was made of a cemented carbide having a composition of 90 wt. % TaC–10 wt. % Ni.

Comparative samples 1*c* and 1*d* were prepared by injection-molding raw materials of the same compositions as those of the present samples 1*a* and 1*b* in similar dies having no core pins, in shapes similar to that shown in FIG. 1 but with no small holes 3. The comparative compacts without any small holes 3 were debindered and sintered similarly to the above, and worked by electric discharge machining, to be provided with small holes 3 in a prismatic portion 2 which holes were similar to hole 3 of the component shown in FIG. 1. Further comparative samples 1*e* and 1*f* were prepared by debindering compacts without any small holes similarly to the above, heating the compacts up to 700° C. in a vacuum for improving the strength thereof, forming small holes by machine work, and sintering the compacts in a similar manner to the above.

Four components were prepared for each of the present samples 1*a* and 1*b* and the comparative samples 1*c* to 1*f*. Average values of surface roughness $R_{max}$ were obtained on the inner surfaces of the small holes 3. Then strength tests were made by applying loads to the prismatic portions 2 as shown by an arrow in FIG. 1, to measure breaking loads. Table 1 shows the results.

TABLE 1

| Sample | Composition | $R_{max}$ (μm) | Breaking Load (kg) | | | |
|---|---|---|---|---|---|---|
| 1a | WC—Ni | 1.2 | 73 | 71 | 74 | 84 |
| 1b | TaC—Ni | 1.8 | 68 | 50 | 49 | 48 |
| *1c | WC—Ni | 22 | 29 | 38 | 27 | 32 |
| *1d | TaC—Ni | 19 | 29 | 36 | 31 | 34 |
| *1e | WC—Ni | 8.7 | 65 | 40 | 51 | 47 |
| *1f | TaC—Ni | 10.5 | 38 | 42 | 59 | 45 |

*Comparative Sample

It was observed that all of the comparative samples 1*c* to 1*f* were broken in the strength tests from starting points defined in the inwardly facing surfaces of the small holes 3, which were formed by electric discharge machining and machine work.

Example 2

Figure 2:
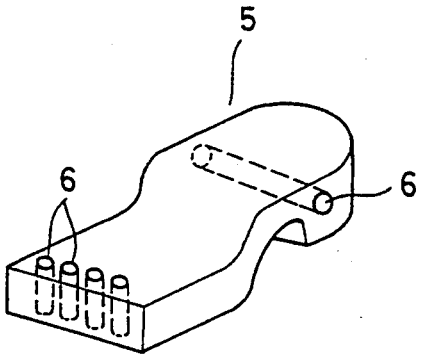
FIG. 2 is a perspective view showing a second example of a hard sintered component having a complex shape according to the present invention.
Figure 3:
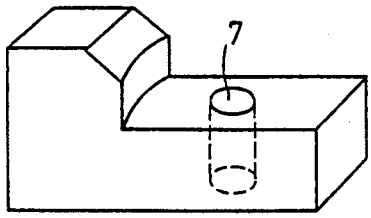
FIG. 3 is a perspective view showing a third example of a hard sintered component having a complex shape according to the present invention.
Figure 4:
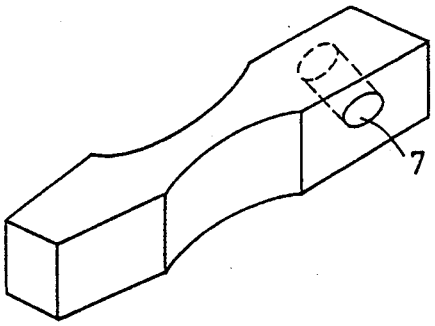
FIG. 4 is a perspective view showing a fourth example of a hard sintered component having a complex shape according to the present invention.
Figure 5:
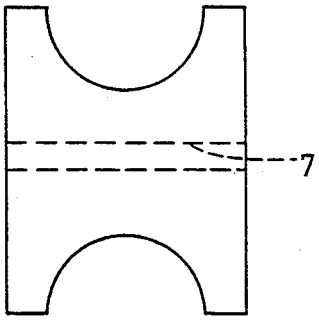
FIG. 5 is a side elevational view showing a fifth example of a hard sintered component having a complex shape according to the present invention.
Figure 6:
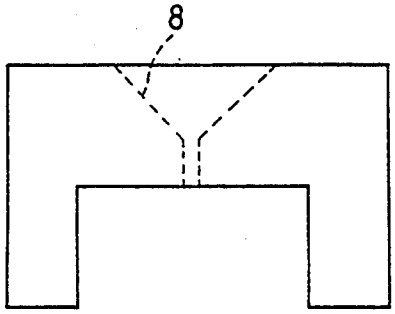
FIG. 6 is a side elevational view showing a sixth example of a hard sintered component having a complex shape according to the present invention.
Figure 7:
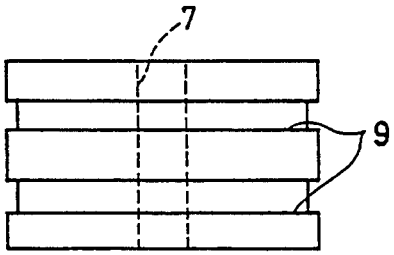
FIG. 7 is a side elevational view showing a seventh example of a hard sintered component having a complex shape according to the present invention.

The same raw material powder mixture as in Example 1 was kneaded with the same organic binders to obtain a kneaded substance, which was then injection-molded with a die having core pins in an injection molding machine, to obtain a compact which was similar in shape to a component shown in FIG. 2. The inner peripheral surface of the die and the outer peripheral surfaces of the core pins were surface-finished to have surface roughness $R_{max}$ of not more than 3 μm. Similarly to Example 1, the organic binders were removed from the compact, which was then sintered in a vacuum at 1400° C. for 30 minutes, to obtain a component 5 of a cemented carbide having the composition of 88 wt. % WC–12 wt. % Ni and a complex shape with two types of small holes 6 of 0.8 mm and 1.2 μm in diameter respectively, as shown in FIG. 2.

A present sample 5*a* was prepared from the component 5, while a comparative sample 5*c* was prepared by injection-molding raw material powder of the same composition as the above into a similar die having no core pins, to obtain a compact which was similar in shape to the component shown in FIG. 2 but not having any small holes 6. The compact without holes 6 was debindered and sintered similarly to Example 1, and then the sintered body was provided with small holes 6 by electric discharge machining, to form a component having the shape shown in FIG. 2. On the other hand, another comparative sample 5*e* was prepared by debindering a similar compact without small holes 6, heating the same up to 700° C. in a vacuum to improve the strength of sample 5*e*, forming small holes 6 by machine work, and sintering the compact, to obtain a component having the shape shown in FIG. 2.

The present sample 5*a* and the comparative samples 5*c* and 5*e*, the sizes of the small holes 6 were measured. The present sample 5*a* attained sufficient accuracy without any secondary working such as electric discharge machining, with a hole diameter accuracy of ±0.03 mm and a hole pitch accuracy of ±0.05 mm. In the comparative sample 5*e* which was prepared by sintering a compact having machine-worked small holes 6, portions close to outlets of the small holes 6 were slightly cracked resulting in a very inferior hole diameter accuracy of ±0.15 mm and a hole pitch accuracy of ±0.12 mm.

The comparative sample 5*c* which was provided with small holes 6 by electric discharge machining after sintering had a satisfactory dimensional accuracy. However, this sample required thicknesses of at least 1.0 mm for portions between the small holes 6 in order to attain the prescribed strength, since the inwardly facing surfaces of the small holes 6 were reduced in strength due to the electric discharge machining. According to the present invention, on the other hand, it was possible to attain the prescribed strength even if such portions were reduced to 0.5 mm in thickness. Thus, it has been shown that it is possible to reduce the component in thickness as well as in weight according to the present invention.

Then, values of surface roughness $R_{max}$ of the sintered surfaces were measured in the respective samples, to find that the surface of the present sample 5*a* and the inner surfaces of the small holes 6 thereof were extremely smooth with a surface roughness of 2 μm. Thus, the present teaching has substantially reduced the number of steps required for polishing in the present invention even if further surface finishing is required. On the other hand, the inner surfaces of the small holes 6, which were sintered surfaces, had a surface roughness $R_{max}$ of 9 μm in the comparative sample 5*e* which was obtained by sintering a compact provided with small holes 6 by machining, while a component which was manufactured by a conventional powder metallurgical method using die compaction exhibited a surface roughness $R_{max}$ of 5 μm.

Example 3

50 percent by weight of Co powder having a mean particle diameter of 2 μm, 8 percent by weight of Cr powder having a mean particle diameter of 5 μm, 5 percent by weight of W powder having a mean particle diameter of 3 μm, and 37 percent by weight of $Cr_7C_3$ having a mean particle diameter of 4 μm were mixed with each other and pulverized in a ball mill containing ethyl alcohol, for 30 hours. The mixed powder was dried and then kneaded with 6 percent by weight of paraffin and 6 percent by weight of polyethylene, serving as organic binders, in a kneader for 2 hours. The kneaded substance was injection-molded into a die having a core pin, to obtain a compact which was similar in shape to the component shown in FIG. 1. The inner surface of the employed die and the outer surface of the core pin were surface-finished to have a surface roughness $R_{max}$ of not more than 3 μm.

The resulting compact was heated up to 400° C. in $N_2$ gas at a rising temperature rate of 15° C./h. and then held for 1 hour, so that the organic binders were removed. Then the debindered compact was sintered in a vacuum at 1250° C. for 30 minutes, to obtain a present sample of a stellite alloy in a composition of 50 wt. % Co–45 wt. % Cr–5 wt. % W, comprising a prismatic portion 2 provided with a small hole 3 having an inner diameter of 1.5 mm in its center and disc portions 4 at both ends.

The surface roughness $R_{max}$ of a plurality of such samples according to the invention was measured in the inner surfaces of the small holes 3. Further, a strength test was made by applying loads to the prismatic portions 2 as shown by the arrow in FIG. 1, thereby measuring breaking loads. Table 2 shows the results. On the other hand, a comparative sample was prepared in a similar manner to the above except for the fact that the inner peripheral surface of a die employed for injection molding and the outer peripheral surface of its core pin were 10 μm in surface roughness $R_{max}$. The comparative sample was subjected to tests similarly to the above. Table 2 shows the results.

TABLE 2

| Sample | $R_{max}$ (μm) | Breaking Load (kg) | | | |
|---|---|---|---|---|---|
| Inventive Sample | 4 | 53 | 60 | 55 | 59 |
| Comparative Sample | 5 | 37 | 50 | 29 | 34 |

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A hard sintered component comprising an alloy prepared by mixing powders selected from a first group essentially consisting of a carbide, a carbonitride and a nitride of an element selected from a second group consisting essentially of groups IVa, Va, and VIa of the periodic table, with a member selected from a third group essentially consisting of iron, cobalt, and nickel, to form a powder mixture which is hard sintered, said hard sintered component further comprising at least one reduced material strength portion having a smooth sintered surface on said reduced material strength portion, at least said smooth sintered surface having a surface roughness $R_{max}$ of 4 μm at the most, and wherein said reduced material strength portion has a thickness that is thinner than the remainder of said hard sintered component, said thickness being 1 mm at the most.

2. The hard sintered component of claim 1, wherein said reduced material strength thinner portion with said smooth sintered surface comprises a three-dimensionally curved surface.

3. The hard sintered component of claim 1, wherein said reduced material strength thinner portion with said smooth sintered surface portion comprises a hole, said smooth sintered surface portion forming a hole surface having said roughness of 4 μm at the most.

4. A hard sintered component comprising a sintered stellite alloy based on Co-Cr-W-C, and at least one component portion having a reduced material strength compared to the material strength of the remainder of said hard sintered component, said reduced material strength portion having a smooth sintered surface, at least said smooth sintered surface having a surface roughness $R_{max}$ of 4 μm at the most.

5. The hard sintered component of claim 4, wherein said reduced material strength portion with said smooth sintered surface has a three-dimensionally curved surface.

6. The hard sintered component of claim 4, wherein said reduced material strength portion with said smooth sintered surface is thinner than the remainder of said hard sintered component, said reduced material strength portion having a thickness of 1 mm or less.

7. The hard sintered component of claim 4, wherein said reduced material strength portion with said smooth sintered surface comprises a hole, said smooth sintered surface forming a hole surface having said roughness of 4 μm at the most.

8. A method for manufacturing a hard sintered component comprising the following steps:

(a) mixing powder selected from a first group consisting essentially of a carbide, a carbonitride and a nitride of an element selected from a second group consisting essentially of groups IVa, Va, and VIa of the periodic table, with a member selected from a third group consisting essentially of iron, cobalt, and nickel, to form a powder mixture, (b) adding an organic binder to said powder mixture and kneading said powder mixture and organic binder to prepare a kneaded substance, (c) providing art injection molding die having a molding cavity configuration with a cavity surface corresponding to said hard sintered component and imparting to at least a portion of said cavity surface corresponding to a reduced material strength portion of said hard sintered component, a surface roughness $R_{max}$ of 3 μm or less, (d) injection molding said kneaded substance in said molding cavity to form a compact, and (e) debindering said compact and then sintering said compact to form said hard sintered component having a surface with a surface roughness $R_{max}$ of 4 μm at the most on said reduced material strength portion.

9. The method of claim 8, wherein said imparting step for making said die cavity surface smooth with a surface roughness $R_{max}$ of 3 82 m at the most is limited to a cavity surface portion covering a three-dimensionally curved surface portion of said compact.

10. The method of claim 8, wherein said imparting step for making said die cavity surface smooth with a surface roughness $R_{max}$ of 3 μm at the most is limited to a cavity surface portion for covering a thin section of said compact, said thin section being thinner than the remainder of said compact.

11. The method of claim 8, wherein said imparting step for making said die cavity surface smooth with a surface roughness $R_{max}$ of 3 μm at the most is limited to a core pin in said die cavity for producing a hole in said compact.

12. A method for manufacturing a hard sintered component comprising the following steps:

(a) mixing powders selected from the group of Co, Cr, W, and C to form a stellite alloy powder mixture, (b) adding an organic binder to said powder mixture and kneading said powder mixture and organic binder to prepare a kneaded substance, (c) providing an injection molding die having a molding cavity configuration with a cavity surface corresponding to said hard sintered component and imparting to at least a portion of said cavity surface corresponding to a reduced material strength portion of said hard sintered component, a surface roughness $R_{max}$ of 3 μm or less, (d) injection molding said kneaded substance in said molding cavity to form a compact, and (e) debindering said compact and then sintering said compact to form said hard sintered component having a surface with a surface roughness $R_{max}$ of 4 μm at the most on said reduced material strength portion.

13. The method of claim 12, wherein said imparting step for making said die cavity surface smooth with a surface roughness $R_{max}$ of 3 μm at the most is limited to a cavity surface portion for covering a three-dimensionally curved surface of said compact.

14. The method of claim 12, wherein said imparting step for making said die cavity surface smooth with a surface roughness $R_{max}$ of 3 μm at the most is limited to a cavity surface portion for covering a thin section of said compact, said thin section being thinner than the remainder of said compact.

15. The method of claim 12, wherein said imparting step for making said die cavity surface smooth with a surface roughness $R_{max}$ of 3 μm at the most is limited to a core pin in said die cavity for producing a hole in said compact.

* * * * *

UNITED STATES PATENT AND TRADEMARK OFFICE
CERTIFICATE OF CORRECTION

PATENT NO. : 5,403,373

DATED : April 4, 1995

INVENTOR(S) : Nobuyuki Kitagawa et al.

It is certified that error appears in the above-identified patent and that said Letters Patent is hereby corrected as shown below: Title page:

In [57] ABSTRACT, line 6, after "compact" insert --in a--.

Col. 2, line 62, after "alloy" insert --,--.
Col. 4, line 19, delete "curved surface";
line 28, after "die" insert --,--;
line 57, after "use." insert a paragraph spacing.

Col. 9, Claim 8, claim line 13, replace "art" by --an--.
Col. 10, Claim 9, claim line 3, replace "82 m" by --μm--.

Signed and Sealed this

Twentieth Day of June, 1995

*Attest:*

Bruce Lehman

BRUCE LEHMAN

*Attesting Officer*

*Commissioner of Patents and Trademarks*